US006361629B2

(12) United States Patent
Mahaffy

(10) Patent No.: US 6,361,629 B2
(45) **Date of Patent: *Mar. 26, 2002**

(54) FLOWABLE SOLID PROPELLANT

(75) Inventor: Kevin E. Mahaffy, Lancaster, CA (US)

(73) Assignee: The United States of America as represented by the Secretary of the Air Force, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/197,541

(22) Filed: Nov. 12, 1998

(51) Int. Cl.[7] ..... C06B 47/00; C06B 45/00; C06B 31/00

(52) U.S. Cl. ..... 149/1; 149/2; 149/45

(58) Field of Search ..... 149/1, 46, 45, 149/3, 2; 60/209, 210, 211, 214

(56) References Cited

U.S. PATENT DOCUMENTS 3,375,147 A * 3/1968 Sparks et al. ..... 149/6
3,622,408 A * 11/1971 Lyerly ..... 149/109
3,704,184 A * 11/1972 Kuehl et al. ..... 149/1
3,764,419 A * 10/1973 Sheeran et al. ..... 149/21
3,808,062 A * 4/1974 Yokogawa et al. ..... 149/40
3,926,698 A * 12/1975 Cook et al. ..... 149/44
4,081,299 A * 3/1978 Griffith ..... 149/41
4,317,691 A * 3/1982 Katsuta et al. ..... 149/2
5,451,277 A * 9/1995 Katzakain et al. ..... 149/19.92
5,734,124 A * 3/1998 Bruenner et al. ..... 149/36
5,837,931 A * 11/1998 Bruenner et al. ..... 149/109.6

* cited by examiner

*Primary Examiner*—Charles T. Jordan
*Assistant Examiner*—Aileen J. Baker
(74) *Attorney, Agent, or Firm*—Thomas C. Stover

(57) ABSTRACT

Provided is a method for preparing a flowable solid propellant wherein a) liquid oxidizer is added to a tank, b) pellets of cross-linked hydrogel polymer are added to the liquid oxidizer in the tank so that liquid oxidizer is absorbed into the pellets to form flowable combustible pellets and c) the combustible pellets are then flowed into a combustion chamber of a vehicle to combust and the combustion products flow out the propulsion nozzle of the vehicle. Also provided are the liquid oxidizer absorbed flowable combustible pellets so made.

6 Claims, 5 Drawing Sheets

FLOWABLE SOLID PROPELLANT

STATEMENT REGARDING FEDERALLY SPONSORED RESEARCH OR DEVELOPMENT

The invention described herein may be manufactured and used by or for the Government for governmental purposes without the payment of any royalty thereon.

BACKGROUND OF THE INVENTION

1. Field of the Invention

This invention relates to a solid propellant, particularly a flowable solid propellant.

2. Description of Related Art

Today, most rocket propulsion falls into one of two categories, namely solid or liquid systems. Solid motors have the advantage of being low cost and storable. These rockets also have their disadvantages such as lower volumetric propellant loading and lack of ability to vary the thrust profile after the motor is manufactured. Liquid engines have the advantage of higher efficiency, higher volumetric loading of the propellants and throttleability. However, the liquid systems suffer most from their high cost, complexity and lack of storability.

There is thus a need for a new propellant that overcomes the above prior art shortcomings.

There has now been discovered a propellant that is storable, flowable, of high volumetric loading and throttleable.

SUMMARY OF THE INVENTION

Broadly the present invention provides a method for preparing a flowable solid propellant comprising, a) adding liquid oxidizer to a tank and b) adding pellets of cross-linked hydrogel polymer to the liquid oxidizer to form a mixture in the tank so that at least some of the liquid oxidizer is absorbed into at least some of the pellets to form flowable combustible pellets.

Also provided is a propellant comprising, cross-linked hydrogel polymer pellets and a liquid oxidizer absorbed in the pellets to form a flowable combustible propellant.

By "propellant" as used herein, is meant the overall mixture in the tank, e.g., of polymer pellets and liquid oxidizer (whether absorbed into the pellets or not, including between them) and additives if any, e.g. of metal, all of which add up to 100 wt.% (of the propellant).

BRIEF DESCRIPTION OF THE DRAWINGS

The invention will become more apparent from the following detailed specification and drawings in which.

DETAILED DESCRIPTION OF THE INVENTION

Figure 1:
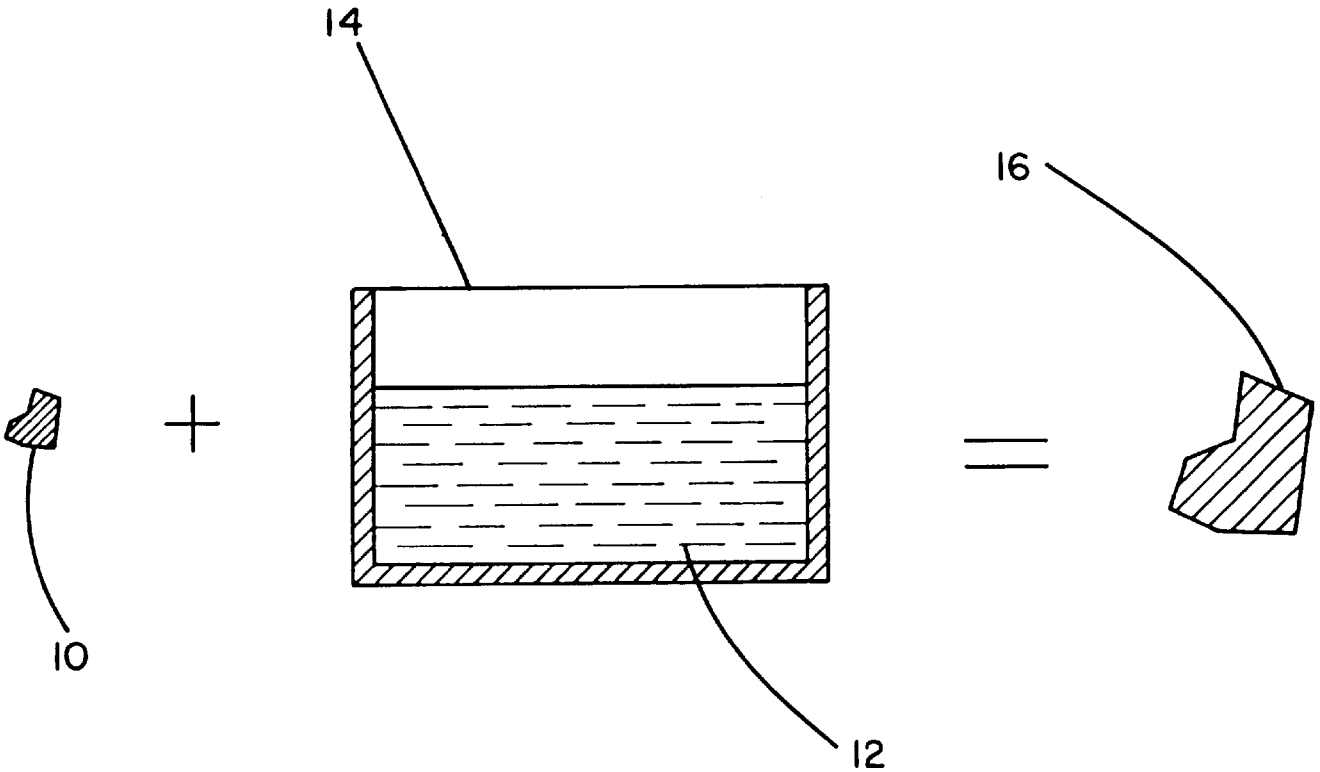
FIG. 1 is a schematic sectional elevation view of a process step embodying the present invention.
Figure 2:
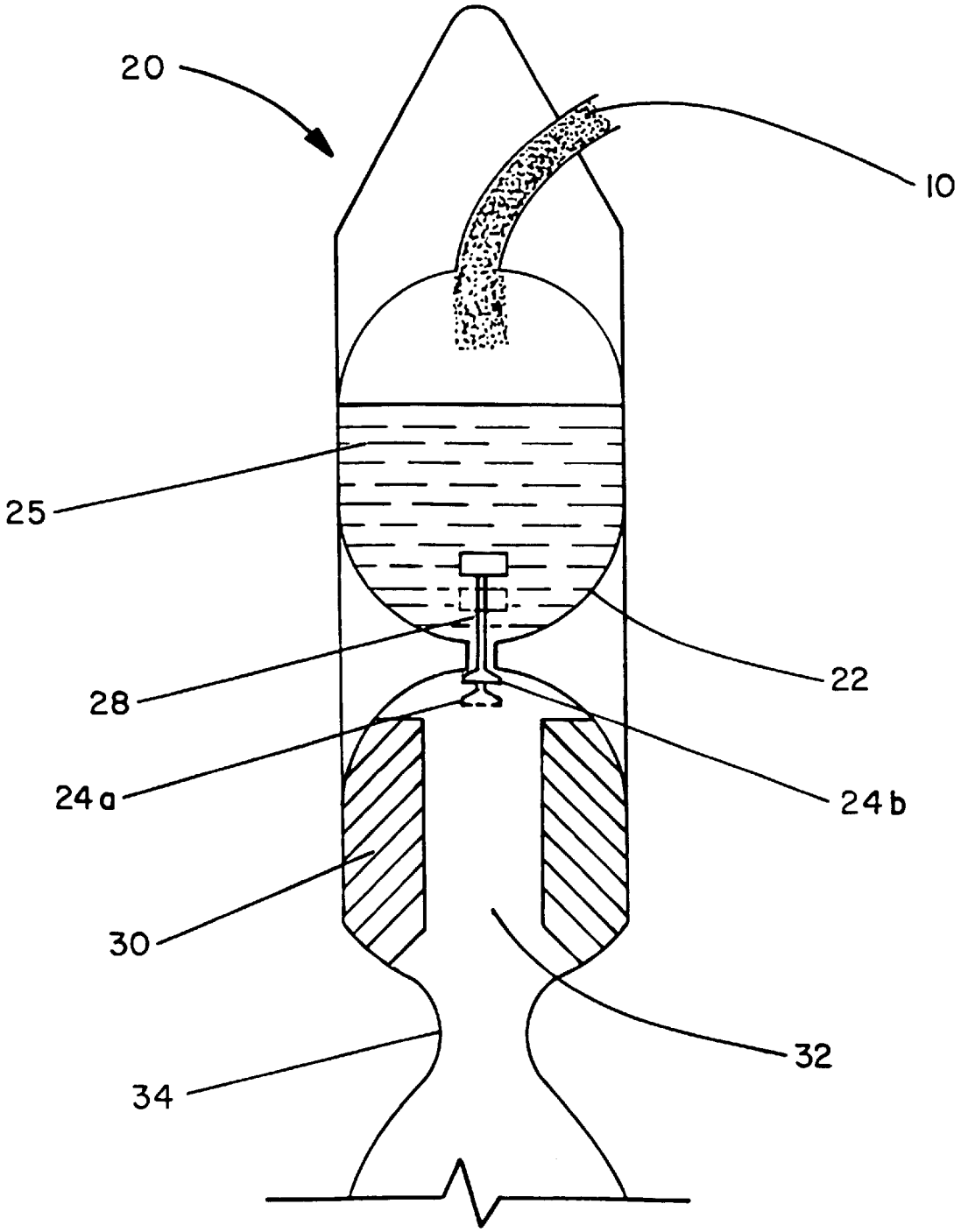
FIG. 2 is a schematic sectional elevation view of another step in a process embodying the present invention.

Referring in more detail to the drawings, a pelletized hydro-gel polymer 10 such as poly vinyl alcohol (PVA) or polyacrylamide (PAM), which can contain other ingredients such as metals, is cross-linked to a specified level and then added to a tank 14 of liquid oxidizer 12 to form a type of solid propellent 16, sometimes called a solution propellant (see FIGS. 1 and 2).

Per the invention, the degree of cross-linking determines the amount of oxidizer absorbed by the polymer. The optimum amount of cross-linking of polymer is determined by testing to obtain the best oxidizer to fuel (O/F) ratio and specific impulse (ISP). This will vary with various polymers but in general such polymer is cross-linked from $2\times10^{-5}$ to $2\times10^{-4}$ moles branch points per gram of polymer, including in the polymer pellets that are later combined with oxidizer per the invention. In this way, a solid propellant can be formed without hazardous mixing operations.

In addition to PVA and PAM, other polymers suitable for use in the pellets of the invention are celluosic hydroxy functional, celluosic methoxy functional, polysaccharides, polyvinyl amines & salts thereof, polyvinyl ethers, polyethylene glycol (PEG), polypropylene glycol, polytetrahydrofuran (PTHF) and co-polymers thereof.

The pellets can be of various sizes per the invention as long as they are flowable into the combustion chamber and fully combustible therein or nearly so. That is, The size of the pellets used will vary according to the application. Larger systems will have larger combustion chambers with longer residence times and hence can use larger pellets. The range of pellet sizes can be as small as 20 microns and as large as 2 cm thick.

The liquid oxidizers that can be used in this system include hydrogen peroxide, hydroxyl ammonium nitrate (HAN) and hydroxyl ammonium dinitromide (HADN). If the system is intended for tactical applications, a very storable oxidizer such as HAN can be used. If a long shelf life is not needed, a low cost oxidizer such as hydrogen peroxide can be sufficient. Other oxidizers that can be used include hydroxyl ammonium (HA) salts, nitrates including ammonium nitrate, dinitromide including ammonium dinitramide, nitroformates including hydroxyl ammonium nitroformate and perchlorates. Also employed are mixtures (e.g., binary, ternary, quarternary . . . ) of nitrates, dinitramides, nitroformates and perchlorates such as ammonium nitrate & HAN; ammonium dinitramide & ammonium nitrate (ADN & AN) and HADN & ammonium nitrate.

Examples of the make-up of the above oxidizers is as follows. For $H_2O_2$ one can have 70–99 wt.% $H_2O_2$, the balance being $H_2O$. For HAN, one can have 80–99 wt.% HAN, the balance being $H_2O$, with like ratios for HADN.

Also by HAN-5 is meant that 5% of the HAN is just AN, i.e., ammonium nitrate and the rest is HAN. Further one can have 80–99 wt.% HAN-5, the balance being $H_2O$, which equals 100% liquid oxidizer.

Then when the polymer pellets are combined with the liquid oxidizer, a preferred range is 10–25 wt.% PVA or PAM., added to the liquid oxidizer, which makes up the balance in the tank whether absorbed in the pellets or not. In Example 1 given below, the ratios are 14 wt.% PVA and 86 wt.% liquid oxidizer in the tank.

The hydro-gel solid propellant can fill a pressure vessel at levels approaching one hundred percent as opposed to eighty percent in a conventional solid rocket motor. The spaces between the pellets in the tank, can be filled with excess oxidizer or monopropellant as indicated above and in FIG. 3.

Thus rocket 20 having tank 22, has liquid oxidizer 25 therein, as shown in FIG. 2. Into the tank 22 is then poured hydrogel polymer pellets 10 per FIG. 2.

Figure 3:
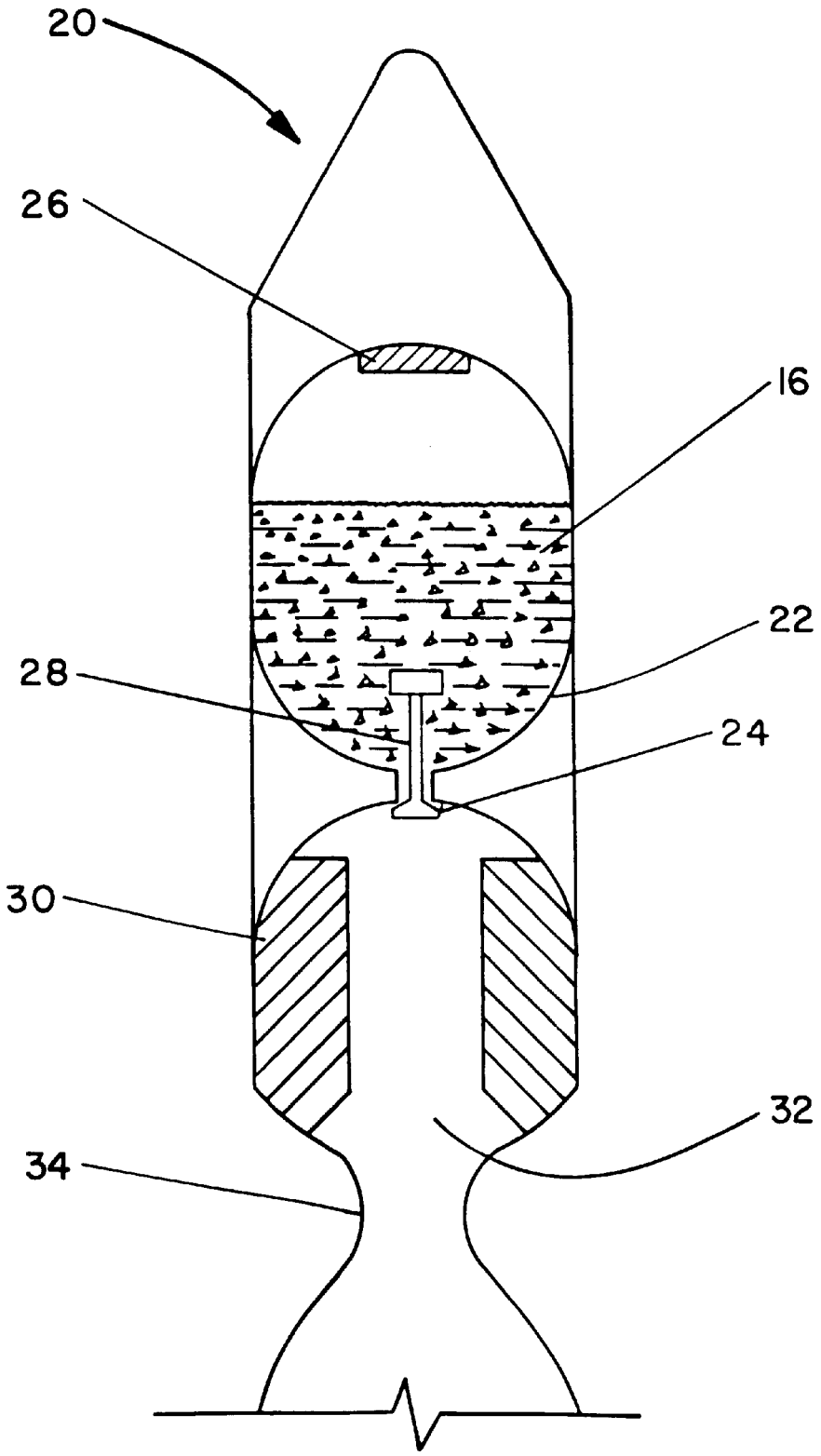
FIG. 3 is a schematic sectional elevation view of yet another step in a process embodying the present invention.

The so poured pellets 10 absorb liquid oxidizer according to the extent of the cross-linked hydrogel therein to form combustible pellets 16 in the tank 22, as shown in FIG. 3. The rocket 20 optionally has an annular solid propellant or fuel lining 30 mounted in the combustion chamber 32, as shown in FIGS. 2 and 3.

Figure 4:
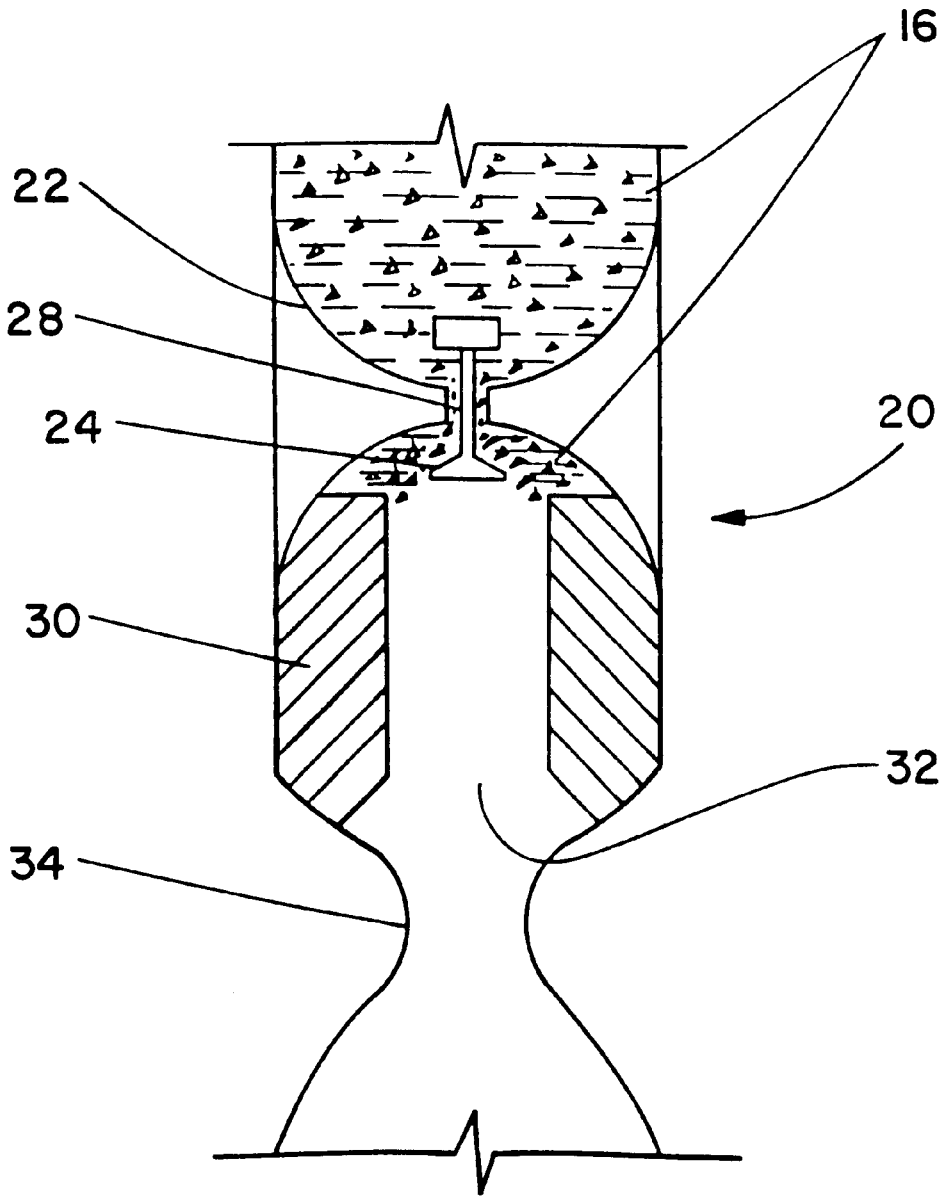
FIG. 4 is a schematic sectional elevation view of still another step in a process embodying the present invention and FIG. 5 is a graph showing a burn rate of a propellant embodying the present invention.

A pressurization system 26 at the top of the propellant tank 22 can cause hydro-gel solid propellant to flow under pressure through a variable valve 24, per FIGS. 3 & 4. This valve allows the rocket's thrust to be throttled and if necessary shut off, as indicated in FIG. 2, with valve open position at 24*a* & valve closed position at 24*b* as shown. The propellant next flows around an injector 28, such as a pig tail or a pintle injector, in order to break up or distribute the stream such that combustion is improved. The propellant then enters a combustion chamber 32 that in some configurations can be lined with solid propellant as noted, to help ignite the hydro-gel propellant 16 and provide higher thrust for boost, as well as increase the mass fraction of the motor. After completing combustion, the gaseous products flow through a conventional rocket nozzle 34.

The following example serves to illustrate the propellant of the present invention and should not be construed in limitation thereof.

EXAMPLE I

Crosslinked PVA/HAN-5 Propellant

I. Preparation of Crosslinked PVA using Borax (Sodium Borate)

1. Prepared Solution of Borax in Water (Borax:Water=1/16 by Weight)

In a beaker, 1.6 g of borax was weighed, then 25.64 ml of water was added. The mixture (1) was stirred until all the borax dissolved into the water.

2. Prepared Solution of PVA in Water (5% of PVA by Weight)

Into a large beaker, 95 g water and ice was added and stirred up well using a glass rod. An amount of 5.007 g of non-heated PVA was added slowly to the mixture of ice and water with stirring. A hot plate was used to heat the mixture of PVA/water slowly up to 80–90 C. A magnetic stirrer was utilized to stir the solution. When the temperature was above 80 C., the white color of this mixture (due to PVA color) disappeared and the solution became thick and clear [mixture (2)].

3. Cross-linking PVA by Adding Solution of Borax

In a smaller beaker, 40.00 g of mixture (2) was weighed, then all the mixture (1) was added with stirring. A 50.4035 g of gel formed. It was transferred to a dry container and dried in an oven at 40 C. for few days. The dry solid was removed from the oven and ground into small pieces.

III. Propellant Formulation

The % ingredients of propellant included:

Cross-linked PVA: 14% and HAN-5: 86%

The above ingredients were weighed in to tiny cups (0.25 'high, 0.094' diameter) which were used to burn propellant in a window bomb. The cups were placed in a desiccator at room temperature for a week to make sure all PVA absorbed HAN-5 had gelled.

| Cup # | weight of cross-linked PVA | weight of HAN-5 |
|---|---|---|
| 1 | invalid | x |
| 2 | invalid | x |
| 3 | .0045 | .0294 |
| 4 | .0046 | .0323 |

-continued

| Cup # | weight of cross-linked PVA | weight of HAN-5 |
|---|---|---|
| 5 | 0045 | .0286 |
| 6 | .0046 | .0296 |
| 7 | .0046 | .0313 |
| 8 | .0052 | .0323 |
| 9 | .0045 | .0274 |
| 10 | .0047 | .0317 |
| 11 | .0044 | .0276 |
| 12 | .0058 | .0370 |
| 13 | .0044 | .0275 |
| 14 | .0048 | .0299 |

III. Results from the Window Bomb

1. Burn Rate of Crosslinked PVA/HAN-5 Based Propellant

Cups filled with HAN-5 and cross-linked PVA were burned in the window bomb at 300, 500, 1000 and 1500 psi. Three tests were done at each pressure. One of the three tests failed at pressures of 300 and 500 psi. Even though the hot wire heated up for a long time and became very bright, the propellant did not ignite, then suddenly it exploded.

Burn rate increase was observed as the pressure increased up to 1000 psi, however, at 1500 psi reduced burn rate was obtained (Table 1):

TABLE 1

Burn Rate of Cross-linked PVA/HAN-5 Based Propellant

| Pressure (psi) | Average Burn Rate (ips) | Burn Rate exponent: |
|---|---|---|
| 300 | 0.2400 | 1.4593 |
| 500 | 0.7576 | |
| 1000 | 2.3810 | |
| 1500 | 2.2936 | |

Figure 5:
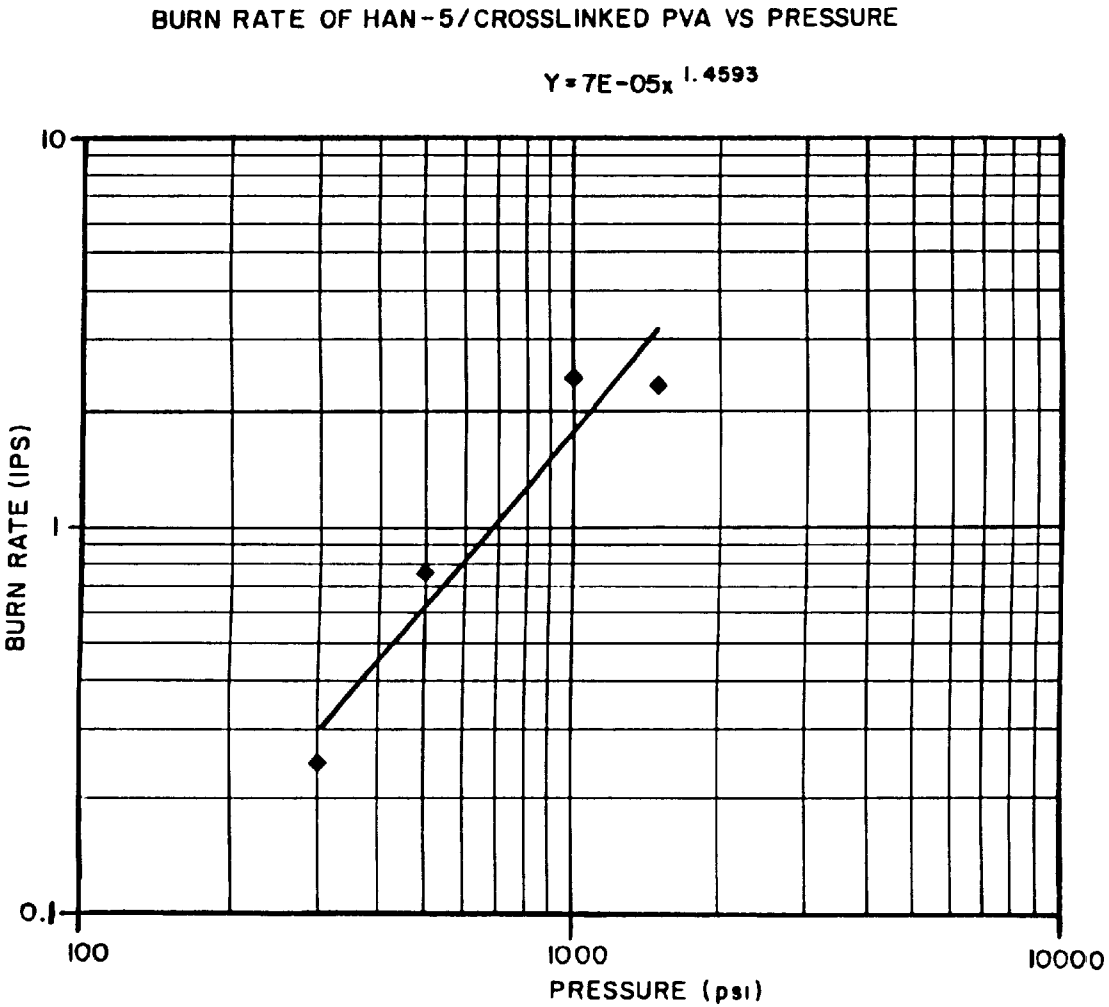

The above data is plotted in the graph of FIG. 5 hereof.

2. Comparison to Liquid Propellants Such as HAN-5 Based Monopropellants

Burn rates of different HAN-5 based monopropellants using window bomb at 1000 psi and the corresponding burn rate exponents are depicted in Table 2:

TABLE 2

Burn Rates and Burn Rate exponents of HAN-5 Based Monopropellants

| | Fuel (%) | HAN-5 (%) | Burn rate (ips) at 1000 psi | Exponent n |
|---|---|---|---|---|
| Methanol | 18 | 82 | .936 | 2.922 |
| Ethanol | 14 | 86 | .833 | 2.016 |
| Isopropanol | 10 | 90 | 1.34 | 2.649 |
| 1-Butyn-2-ol | 14 | 86 | 2.94 | |

Thus the flowable solid propellant of the invention compares favorably with prior art liquid propellants which, however, have the limitations noted above.

In the above example, cross-linking of the polymer takes place chemically as indicated in step 3 above. However, on a commercial scale, the polymer is best cross-linked by electron beam irradiation thereof. For examples of such process, see the following two Articles:

S. H. Hyon and Y. Ikada, *Radiation Crosslinking of Biomedical Hydrogels,* 6th Symposium on Radiation Chemistry, 1986 and PL-TR-97-3039, *Radiation Induced Bonding/Crosslinking of PVA Film,* Walter Chappas, Damilic Corporation, Phase I SBIR (1997)

which are incorporated herein by reference.

The invention thus creates a rocket motor with several advantages; a rocket motor with high propellant loading, no hazardous mixing operation, low cost propellants, variable thrust levels and uses simple, low cost hardware.

Thus the invention has many advantages in certain applications. In comparison to solid rocket motors, It allows the production of a rocket motor with high propellant loading because the propellant can fill up the entire pressure vessel. This allows more total impulse to be packaged into the same volume. Also, there is no need for insulation and its associated inert weight and volume in the tank where the injectable solution propellant is stored. However, there can be some inert weight for systems such as injectors and expulsion systems. Unlike solid rocket motors, there are no hazardous mixing operations as well as the costs associated with working with hazardous materials. The propellant filling procedure can be done on the launch pad where the propellant of this invention is used in space operations. This eliminates the cost associated with transporting a heavy and hazardous missile to the launch site. It also eases launch site operations. The propellants themselves are of low cost.

Solid rocket motors sometime require very extensive range safety equipment to terminate thrust in the case of system failure. This is causing solid propulsion to lose its attractiveness to some users. In the present invention, thrust can be terminated by closing a valve and at worst by depressurizing the propellant tank.

Another advantage of this invention is the lack of bonded surface area of solid propellant. Bondliner failures are a major source of reliability problems in solid rocket motors. This concept uses solid propellant in such a way as to obviate the need for case bondliners. The propellant also does not need strong mechanical properties such as modulus, tensile strength, and elongation. This has been a particularly difficult problem in solution propellants to date. Since no combustion takes place in the propellant tank, the inert weight associated with insulation is unnecessary. The combustion chamber can be smaller which further reduces failure modes compared to solid rockets.

In contrast to liquid rockets, the hardware used in this invention can be very low cost. The rocket will use one propellant tank instead of two and hence one pressurization system, and one injector. The injector can be cheap and simple since it only has to break up the stream of pellets not mix two separate liquids. The motor can also be easy to throttle since opening and closing a valve can change the mass flow rate of propellant entering the chamber. Combustion efficiency will not be difficult to obtain because unlike traditional liquid systems, the fuel and oxidizer are already intimately mixed. Preferably the propellant pellets are made small enough in size to complete combustion. (or nearly so) before entering the nozzle throat.

A non-obvious advantage of this invention is ability to modify the properties of the liquid oxidizer. For example, the vapor pressure and freezing point of high concentration hydrogen peroxide is higher than would be desired for many applications. When utilized in the manner described by this invention, these difficulties may be overcome as the freezing point of the liquid oxidizer is lowered by absorption into the polymer pellets and also the pellets continue to be flowable in declining temperatures.

There are undoubtedly numerous other advantages that can be listed for this invention, but the last to be listed here is the ability to demilitarize or decommission the system. In traditional solid propellants it is difficult to remove the solid propellant from the case and then dispose of it in a safe and environmentally acceptable manner. However, the technology used in this invention allows the propellant to be poured out of the case and then dispersed in non-hazardous quantities. The propellant can then be rendered harmless with a simple dehydration process.

In another embodiment the combustion chamber is lined with solid propellant as noted above. The solid propellant can help ignite the hydro-gel propellant, provide higher thrust for boost, as well as increase the mass fraction of the motor, but it is an extra, relative to the basic invention.

In a further embodiment of the invention, certain metals can be added to enhance the performance of the combustible pellets of the invention. That is, certain metals can be added in powder form to the polymer before it is cross-linked. Thus, 0–25 wt.% of the propellant can be metal powder selected from the group of Al, Be, Mg and Li or a combination thereof, which is added to such polymer before it is cross-linked. For a further description of this process, see e.g., U.S. Pat. No. 5,451,277 to Arthur Katzakian et.al (1995), which is incorporated herein by reference.

What is claimed is:

1. A propellant comprising, cross-linked hydrogel polymer pellets and a liquid oxidizer absorbed in said pellets which however remain flowable pellets to form a flowable combustible propellant.

2. The propellant of claim 1 wherein said pellets are of a polymer selected from the group of polyvinyl alcohol (PVA), polyacrylamide (PAM), celluosic hydroxy functional, celluosic methoxy functional, polysaccharides, polyvinyl amines & salts thereof, polyvinyl ethers, polyethylene glycol (PEG), polypropylene glycol, polytetrahydrofuran (PTHF) and co-polymers thereof.

3. The propellant of claim 1 wherein said hydrogel pellets are cross-linked from $2\times10^{-5}$ to $2\times10^{-4}$ moles branch points per gram of polymer.

4. The propellant of claim 1 wherein said liquid oxidizer is selected from the group of hydrogen peroxide, hydroxyl ammonium nitrate (HAN), hydroxyl ammonium dinitromide (HADN), hydroxyl ammonium (HA) salts, nitrates, ammonium nitrate, dinitramides, ammonium dinitramide, nitroformates, hydroxyl ammonium nitroformate and perchlorates and mixtures of nitrates, dinitramides, nitroformates and perchlorates, ammonium nitrate & HAN, ammonium dinitramide & ammonium nitrate (ADN & AN) and HADN & ammonium nitrate.

5. The propellant of claim 1 wherein said polymer has metal therein selected from the group of Al, Be, Mg and Li or a combination thereof, which metal can be 0–25 wt. % of the propellant.

6. The propellant of claim 1 wherein said pellets flow through an injector valve.

* * * * *